US010005098B2

(12) United States Patent
Hsu et al.

(10) Patent No.: US 10,005,098 B2
(45) Date of Patent: Jun. 26, 2018

(54) POWER OPERATED DISPENSING TOOL

(71) Applicant: Techway Industrial Co., Ltd., Taichung (TW)

(72) Inventors: Chih-Hua Hsu, Taichung (TW); Rui-Heng Lin, Taichung (TW); Chen-Chen Cheng, Taichung (TW)

(73) Assignee: TECHWAY INDUSTRIAL CO., LTD., Taichung (TW)

( * ) Notice: Subject to any disclaimer, the term of this patent is extended or adjusted under 35 U.S.C. 154(b) by 30 days.

(21) Appl. No.: 15/206,906

(22) Filed: Jul. 11, 2016

(65) Prior Publication Data

US 2018/0008999 A1 Jan. 11, 2018

(51) Int. Cl.

| | |
|---|---|
| ***B65D 83/76*** | (2006.01) |
| ***B05C 17/01*** | (2006.01) |
| ***B05C 17/005*** | (2006.01) |

(52) U.S. Cl.

CPC .... *B05C 17/0103* (2013.01); *B05C 17/00596* (2013.01); *B05C 17/012* (2013.01)

(58) Field of Classification Search

CPC ..... B05C 17/0103; B05C 17/00596; B05C 17/012

USPC ..... 222/137, 327, 390, 386, 571, 63, 333, 222/262

See application file for complete search history.

(56) References Cited

U.S. PATENT DOCUMENTS

| | | | | | |
|---|---|---|---|---|---|
| 3,208,638 | A * | 9/1965 | Frenzel | B05C 17/0103 | 222/333 |
| RE26,180 | E * | 4/1967 | Frenzel et al. | B05C 17/01 | 141/27 |
| 3,632,936 | A * | 1/1972 | Piber | H01H 1/403 | 173/170 |
| 4,335,834 | A * | 6/1982 | Zepkin | B05C 17/0103 | 222/327 |
| 4,583,934 | A * | 4/1986 | Hata | B05C 17/0103 | 222/327 |
| 4,615,469 | A * | 10/1986 | Kishi | B05C 17/0103 | 222/327 |
| 4,669,636 | A * | 6/1987 | Miyata | B05C 17/0103 | 222/153.01 |
| 5,341,958 | A * | 8/1994 | Bayat | B05C 17/0103 | 222/333 |
| 5,450,988 | A * | 9/1995 | Jerdee | B05C 17/0103 | 222/333 |

(Continued)

*Primary Examiner* — Patrick M Buenchner
*Assistant Examiner* — Michael J Melaragno
(74) *Attorney, Agent, or Firm* — Hamre, Schumann, Mueller & Larson, P.C.

(57) ABSTRACT

A power operated dispensing tool includes a housing having a material packing receiving space, and a rod disposed within and movable relative to the housing and having a plunger head that is disposed in the material packing receiving space. The rod is operably coupled to a power transmitting mechanism so as to make a forward movement driven by a power of a motor through the power transmitting mechanism to discharge a dispensing material in the material packing receiving space. The rod has an initiating portion disposed to actuate a sensing member in the housing to deactivate the motor when the rod is moved forwardly to a first stop position. The rod can be moved manually to a second stop position to project the plunger head outwardly so as to permit a plunger kit to be attached thereto.

10 Claims, 12 Drawing Sheets

(56) References Cited

U.S. PATENT DOCUMENTS 5,556,009 A * 9/1996 Motzko ..... B05B 12/085 192/125 A
5,762,239 A * 6/1998 Cossette ..... B05C 17/00553 222/326
5,775,539 A * 7/1998 Bates ..... B05C 17/0103 222/1
6,123,235 A * 9/2000 Hsu ..... B05C 17/0103 192/69.7
6,540,113 B2 * 4/2003 Gardos ..... B05C 17/0103 222/137
6,889,872 B2 * 5/2005 Herman ..... B05C 17/00506 222/137
6,938,531 B2 * 9/2005 Yoshimizu ..... B23D 15/04 192/141
7,004,357 B2 * 2/2006 Shew ..... F16N 3/12 222/256
7,116,071 B2 * 10/2006 Glasgow ..... B05C 17/00503 222/1
7,249,695 B2 * 7/2007 Shew ..... F16N 11/08 222/258
7,584,871 B2 * 9/2009 Huang ..... F16N 3/12 184/105.2
7,690,530 B2 * 4/2010 Schneider ..... B05C 17/00513 222/105
7,703,643 B2 * 4/2010 Wang ..... B05C 17/00589 222/1
7,854,348 B2 * 12/2010 Wang ..... G01F 11/026 222/326
7,896,201 B2 * 3/2011 Strobel-Schmidt . B05C 17/0103 222/326
7,971,758 B2 * 7/2011 Campbell ..... B05C 17/0103 222/326
8,011,538 B2 * 9/2011 Herman ..... B05C 17/01 222/326
8,020,727 B2 * 9/2011 Herman ..... B05C 17/0103 222/1
8,251,158 B2 * 8/2012 Tomayko ..... B23B 45/008 173/11
8,528,785 B2 * 9/2013 Naughton ..... B05C 17/00553 222/137
8,584,907 B2 * 11/2013 Schneider ..... B05C 17/0103 173/170
8,740,021 B2 6/2014 Naughton et al.
2007/0068973 A1 * 3/2007 Herman ..... B05C 17/00576 222/386
2009/0039113 A1 * 2/2009 Hsu ..... B05C 17/0103 222/333
2009/0101673 A1 * 4/2009 Alioto ..... B05C 17/00553 222/113
2010/0006605 A1 * 1/2010 Sung ..... B05C 17/0103 222/327
2010/0116863 A1 * 5/2010 Suda ..... B25C 1/008 227/8
2011/0068130 A1 * 3/2011 Mitrovic ..... B05C 17/0103 222/386
2011/0151042 A1 * 6/2011 Strobel-Schmidt . B05C 17/0103 425/145
2012/0118917 A1 * 5/2012 Naughton ..... G01F 11/00 222/333
2013/0020350 A1 * 1/2013 Gardos ..... A01M 3/00 222/1
2013/0043281 A1 * 2/2013 Hsu ..... B05C 17/0103 222/333
2013/0270302 A1 * 10/2013 Hsu ..... B05B 12/002 222/333

* cited by examiner

POWER OPERATED DISPENSING TOOL

FIELD

The disclosure relates to a power operated dispensing tool, and more particularly to a power operated dispensing tool accommodating different packing styles of dispensing material.

BACKGROUND

A conventional powered dispensing gun as disclosed in U.S. Pat. No. 8,740,021 B2 includes four cartridges of different styles and sizes detachably connected to a tool housing by a quick-change assembly for accommodating two different packing styles of dispensing material, i.e., a cardboard tube-style and a sausage pack. Each of the cartridges has an individual rack and a plunger mounted therein, which are required to be replaced therewith upon change of the cartridges, thereby resulting in inconvenience during use and carrying.

Referring to FIG. 1, another conventional power operated dispensing tool includes a main housing 1 with a cartridge housing 101 attached to the front end thereof, a micro switch 2 disposed at the rear end of the housing 1, and a rod 3 driven by a motor (not shown). The rod 3 has a rack 301 and a handle 302 disposed at the rear end of the rack 301. Two different sizes and configurations of plungers 303, 304 are removably disposed at the front end of the rack 301 to be used with a cardboard tube-style cartridge and a sausage pack cartridge, respectively. The rod 3 is moved forwardly until the handle 302 contacts the micro switch 2 to stop the motor, where the plunger 303 stays in the cartridge housing 101. Hence, once replacement of the plunger is required, it is necessary to operate a hand tool 4 to get access to the cartridge housing 101 for removing the plunger 303 from the rod 3 and then installing another plunger 304, which results in quite an inconvenience during the replacement.

SUMMARY

Therefore, an object of the disclosure is to provide a power operated dispensing tool that can alleviate at least one of the drawbacks of the prior art.

According to the disclosure, a power operated dispensing tool includes a housing having a tubular dispensing portion that extends in a lengthwise direction to define a material packing receiving space therein and to terminate at a forward end, a motor disposed within the housing, a sensing member fixed within the housing and electrically connected with the motor, a power transmitting mechanism disposed within the housing and driven by the motor, and a rod disposed within and movable relative to the housing in the lengthwise direction and having at a front end thereof a plunger head that is disposed in the material packing receiving space. The rod is operably coupled to the power transmitting mechanism so as to make a forward movement driven by a power of the motor through the power transmitting mechanism to discharge a dispensing material in the material packing receiving space. The rod has an initiating portion disposed to actuate the sensing member to deactivate the motor when the rod is moved forwardly to a first stop position, where the plunger head is disposed in the material packing receiving space. The rod is disposed to be manually moved from the first stop position to a second stop position, where the plunger head projects outwardly of the forward end of the tubular dispensing portion and where the initiating portion is disposed forwardly of the sensing member. A plunger kit is configured to be removably engaged with the plunger head and is movably disposed in the material packing receiving space in the lengthwise direction.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
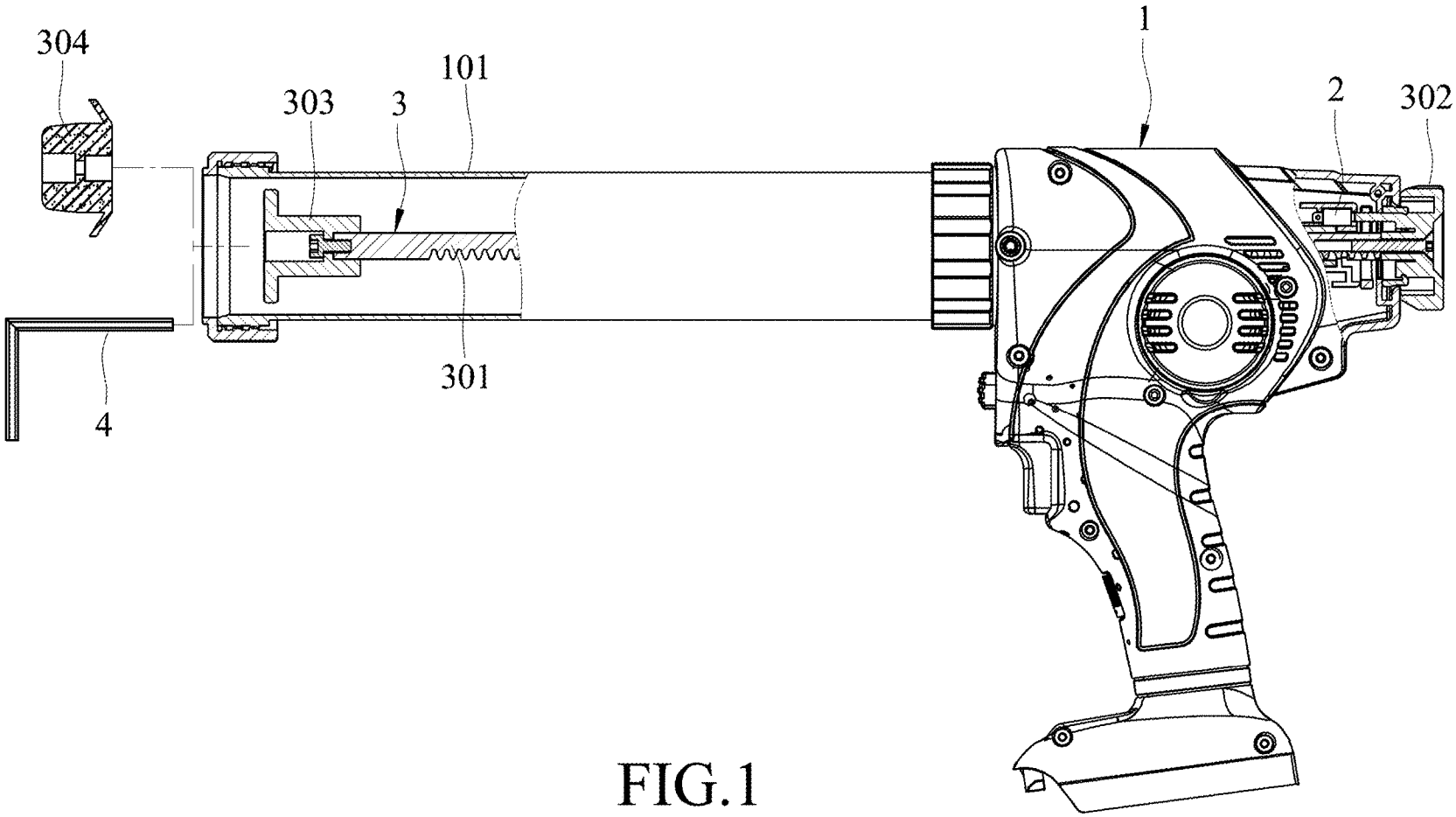
FIG.1 PRIOR ART
FIG. 1 is a partly sectioned view of a conventional power operated dispensing tool and a hand tool.
Figure 2:
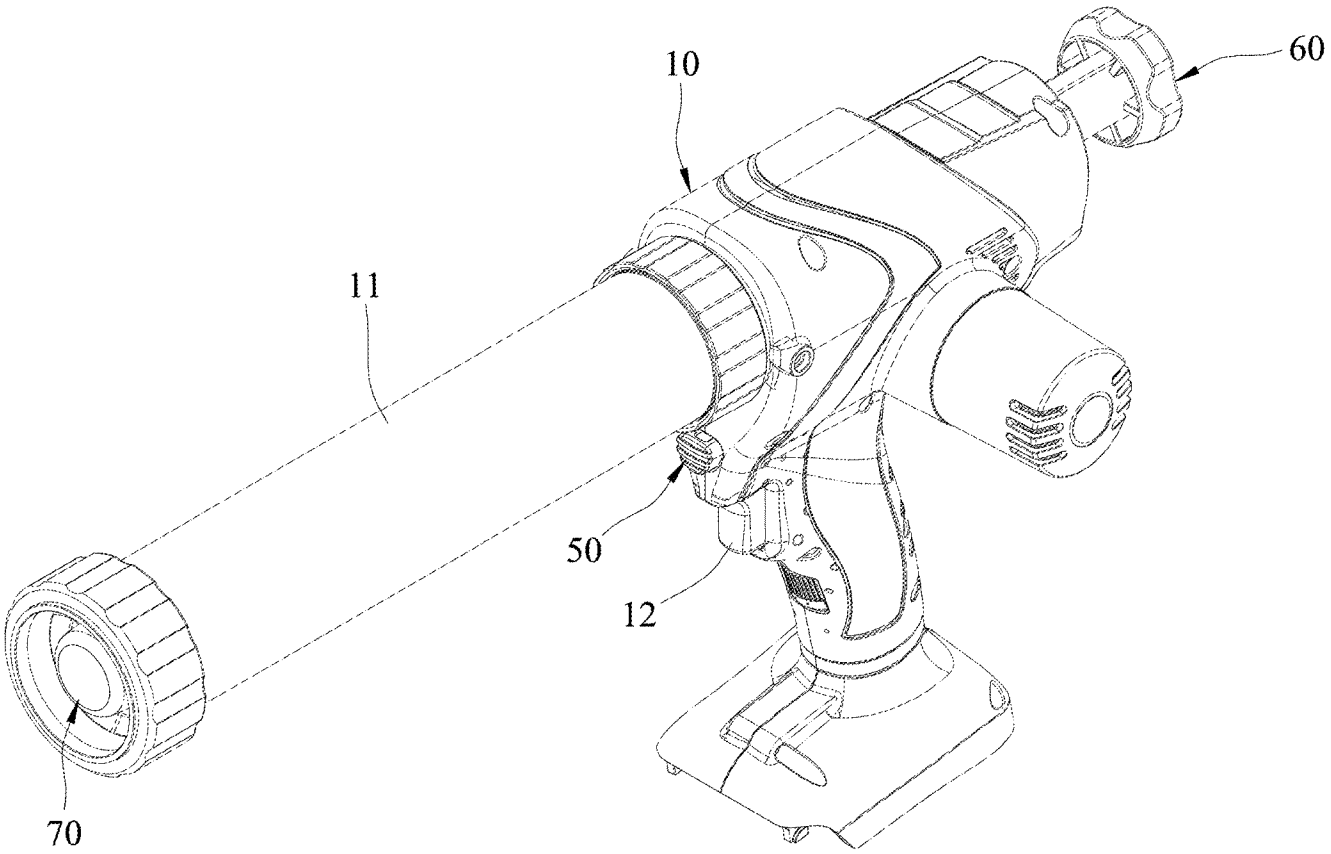
FIG. 2 is a perspective view of an embodiment of a power operated dispensing tool according to the disclosure.
Figure 3:
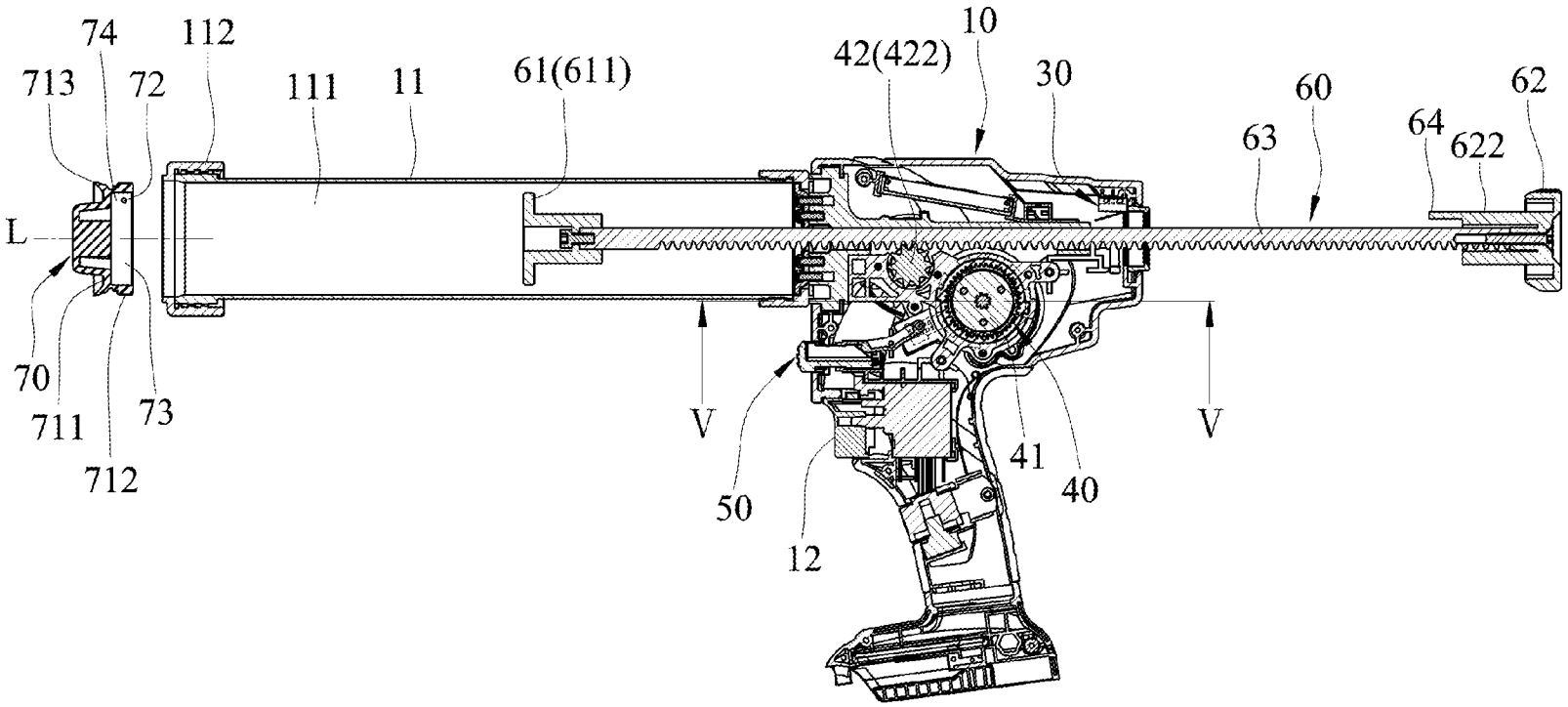
FIG. 3 is a sectional view of the embodiment.
Figure 4:
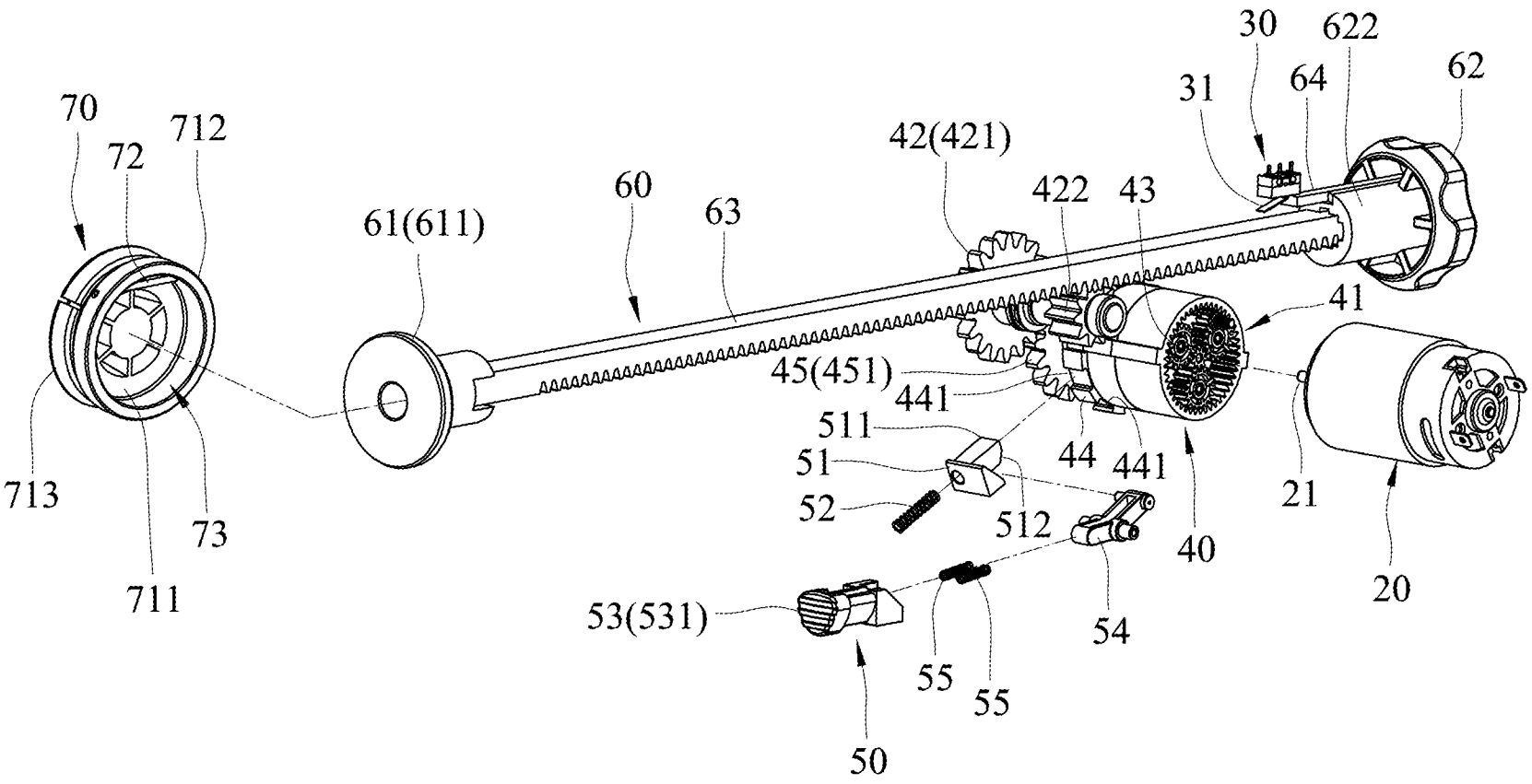
FIG. 4 is an exploded perspective view of a portion of the embodiment.

Referring to FIGS. 2 to 4, an embodiment of a power operated dispensing tool according to the present disclosure includes a housing 10, a motor 20, a sensing member 30, a power transmitting mechanism 40, a clutch mechanism 50, a rod 60 and a plunger kit 70.

The housing 10 has a tubular dispensing portion 11 that extends in a lengthwise direction (L) to define a material packing receiving space 111 therein and to terminate at a forward end 112. The motor 20 is disposed within the housing 10, and has an output shaft 21. A trigger 12 is disposed to be pressed for actuating the motor 20. The sensing member 30 is fixed within the housing 10 and is electrically connected with the motor 20. In this embodiment, the sensing member 30 is in the form of a limit switch which has a pressing tongue 31 at a bottom thereof.

Figure 5:
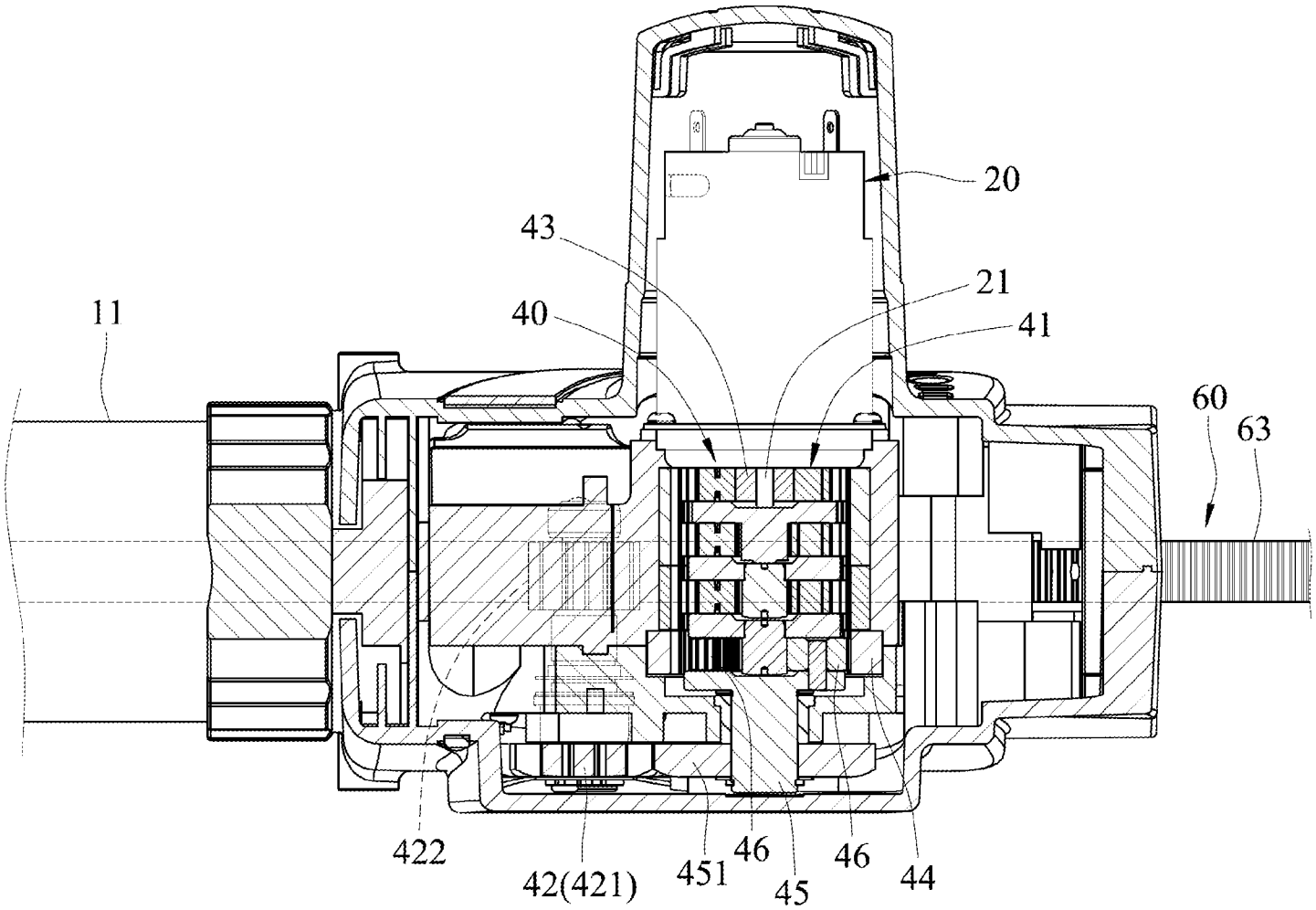
FIG. 5 is a fragmentary sectional view taken along line V-V of FIG. 3.

Referring to FIGS. 3 to 5, the power transmitting mechanism 40 is disposed within the housing 10 and is driven by the motor 20. Specifically, the power transmitting mechanism 40 includes a planetary gear train 41 and an idle gear 42. The planetary gear train 41 includes a sun gear 43 journalled on the output shaft 21 to receive the power of the motor 20, an annular gear 44 rotatably disposed within the housing 10, a carrier 45 rotatable and co-axial with the sun gear 43, and at least one planet gear 46 (three in this embodiment) pivotably supported on the carrier 45 and meshed with the annular gear 44. The annular gear 44 has a plurality of grooves 441 angularly displaced from each other. The three planet gears 46 in this embodiment are operably coupled with the sun gear 43.

In this embodiment, the planetary gear train 41 is in the form of a multiple-stage planetary gear train. In particular, the sun gear 43 is one of the first stage planet gear set, and the annular gear 44, the carrier 45 and the planet gears 46 belong to the most downstream stage planet gear set from the output shaft 21 of the motor 20. Since the construction of the multiple-stage planetary gear train is a hitherto known type, such as those disclosed in U.S. Pat. No. 5,909,830 and Taiwanese Patent No. 1316877, detailed description for it will not be required.

In this embodiment, the carrier 45 has an output gear portion 451. The idle gear 42 is rotatably disposed within the housing 10, and has a first gear portion 421 meshing with the output gear portion 451, and a second gear portion 422 meshing with a rack portion 63 of the rod 60.

Figure 6:
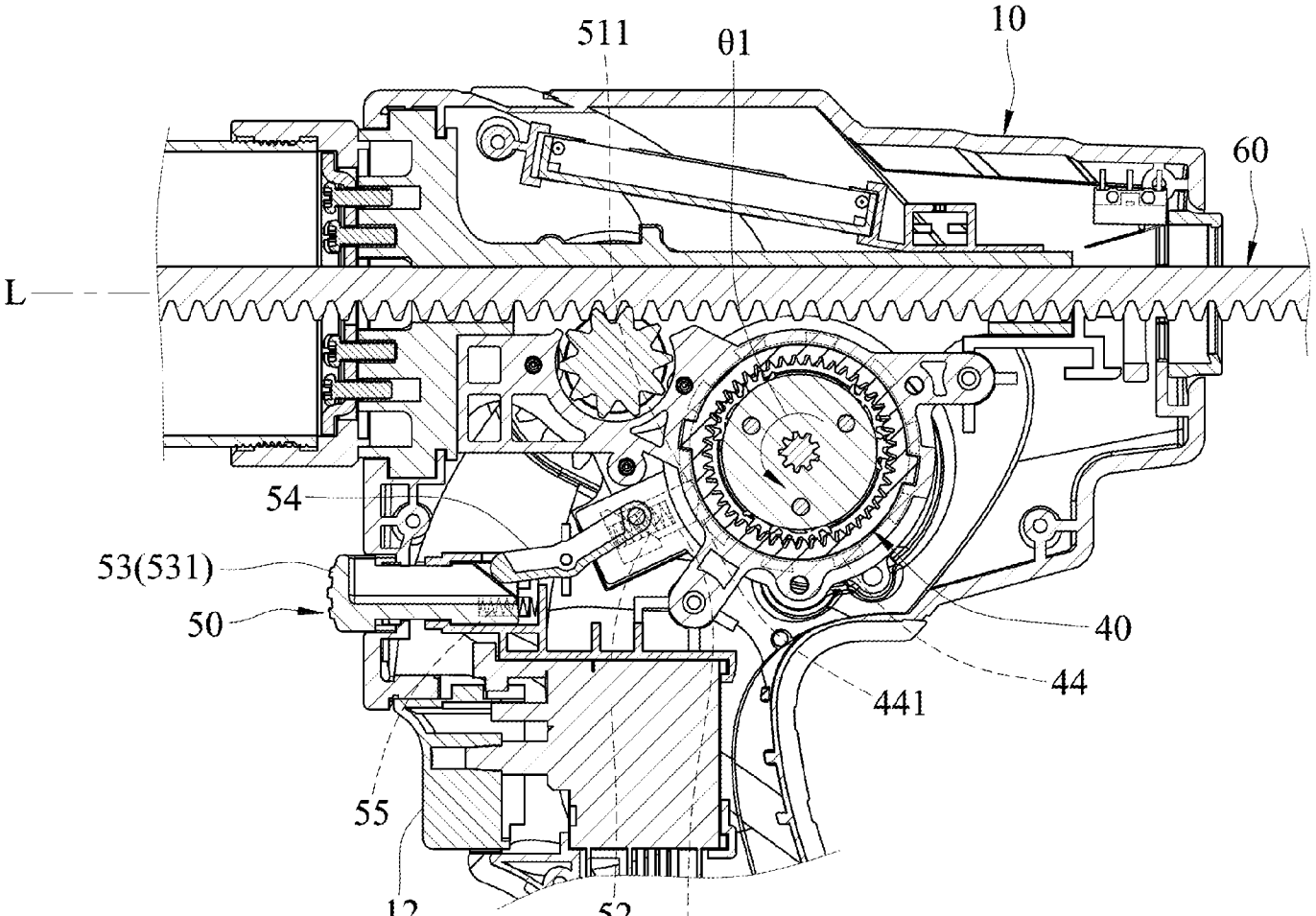
FIG. 6 is a fragmentary sectional view illustrating a clutch mechanism in an engaged position.
Figure 7:
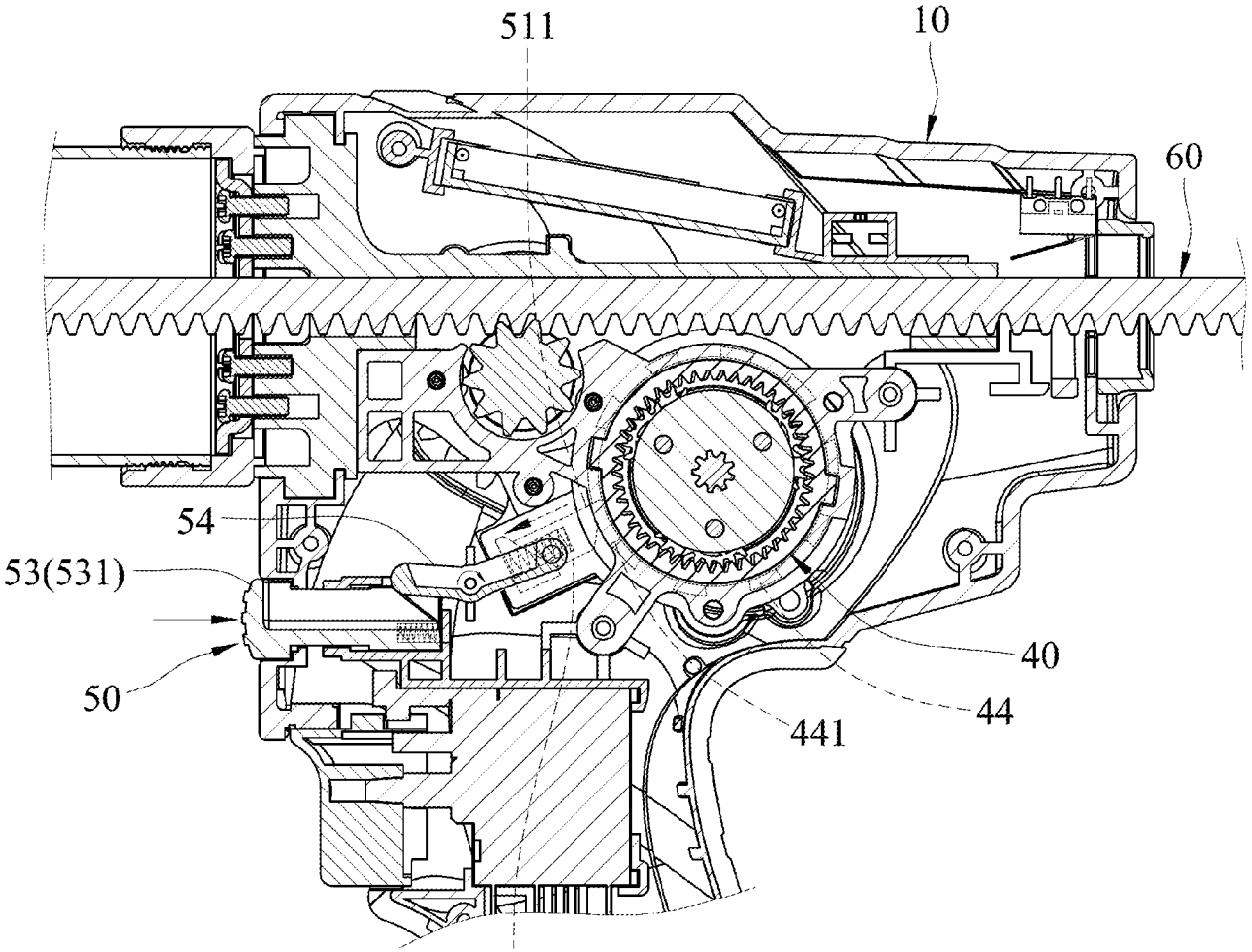
FIG. 7 is a fragmentary sectional view illustrating the clutch mechanism in a disengaged position.

Referring to FIGS. 4, 6 and 7, the clutch mechanism 50 is disposed within the housing 10 and is operable between an engaged position (see FIG. 6) and a disengaged position (see FIG. 7). The clutch mechanism 50 has an engaging pawl member 51 movably disposed in the housing 410, a first biasing member 52 abutting between the engaging pawl member 51 and the housing 10, a manually operable member 53 movable relative to the housing 10, a connecting member 54 pivotably disposed on the housing 10 and interconnecting the engaging pawl member 51 and the manually operable member 53, and two second biasing members 55 abutting between the manually operable member 53 and the housing 10.

The engaging pawl member 51 has an engaging pawl portion 511 and a slipping surface 512 opposite to the engaging pawl portion 511. The first biasing member 52 is disposed to bias the engaging pawl member 51 toward the annular gear 44. The second biasing members 55 are disposed to bias an outer portion 531 of the manually operable member 53 outwardly of the housing 10.

In this embodiment, with reference to FIGS. 4 and 6, when the clutch mechanism 50 is in the engaged position, the engaging pawl portion 511 is engaged in one of the grooves 441 of the annular gear 44 to prevent rotation of the annular gear 44 in a first rotational direction (θ1). Thus, the clutch mechanism 50 is engaged with the power transmitting mechanism 40. When the motor 20 is activated by depressing the trigger 12, the power of the motor 20 is transmitted through the power transmitting mechanism 40 to make the forward movement of the rod 60 in the lengthwise direction (L). Referring to FIGS. 4 and 7, when the clutch mechanism 50 is in the disengaged position, the engaging pawl member 51 is disengaged from the annular gear 44 so as to permit free rotation of the annular gear 44 to disenable the transmission of the power transmitting mechanism 40 to the rod 60. The user can press the manually operable member 53 inwardly of the housing 10 to turn the connecting member 54: so as to move the engaging pawl portion 511 away from one of the grooves 441 of the annular gear 44. Since the operation of the clutch mechanism 50 is of a hitherto known type, such as that disclosed in Taiwanese Patent No. I440509, detailed description for it will not be required.

Referring to FIGS. 3 and 4, the rod 60 is disposed within and is movable relative to the housing 10 in the lengthwise direction (L), and has at a front end thereof a plunger head 61 that is disposed in the material packing receiving space 111 and that has a thrust wall 611. The rod 60 is operably coupled to the power transmitting mechanism 40 so as to make a forward movement driven by the power of the motor 20 through the power transmitting mechanism 40 to discharge a dispensing material in the material packing receiving space 111. Specifically, the rod 60 has an operated portion 62 disposed opposite to the plunger head 61 to extend outwardly and rearwardly of the housing 10 so as to be operated manually, the rack portion 63 interposed between the operated portion 62 and the plunger head 61, and an initiating portion 64 disposed between the operated portion 62 and the rack portion 63. The rack portion 63 is operably coupled with the carrier 45. Specifically, the rack portion 63 is disposed to mesh with the second gear portion 422 of the idle gear 42 so as to be coupled with the output gear portion 451 of the carrier 45 through the first gear portion 421 such that rotation of the sun gear 43 is translated to a displacement of the rod 60 in the lengthwise direction (L). The initiating portion 64 is disposed on a front end of a barrel 622 extending from the operated portion 62.

Figure 8:
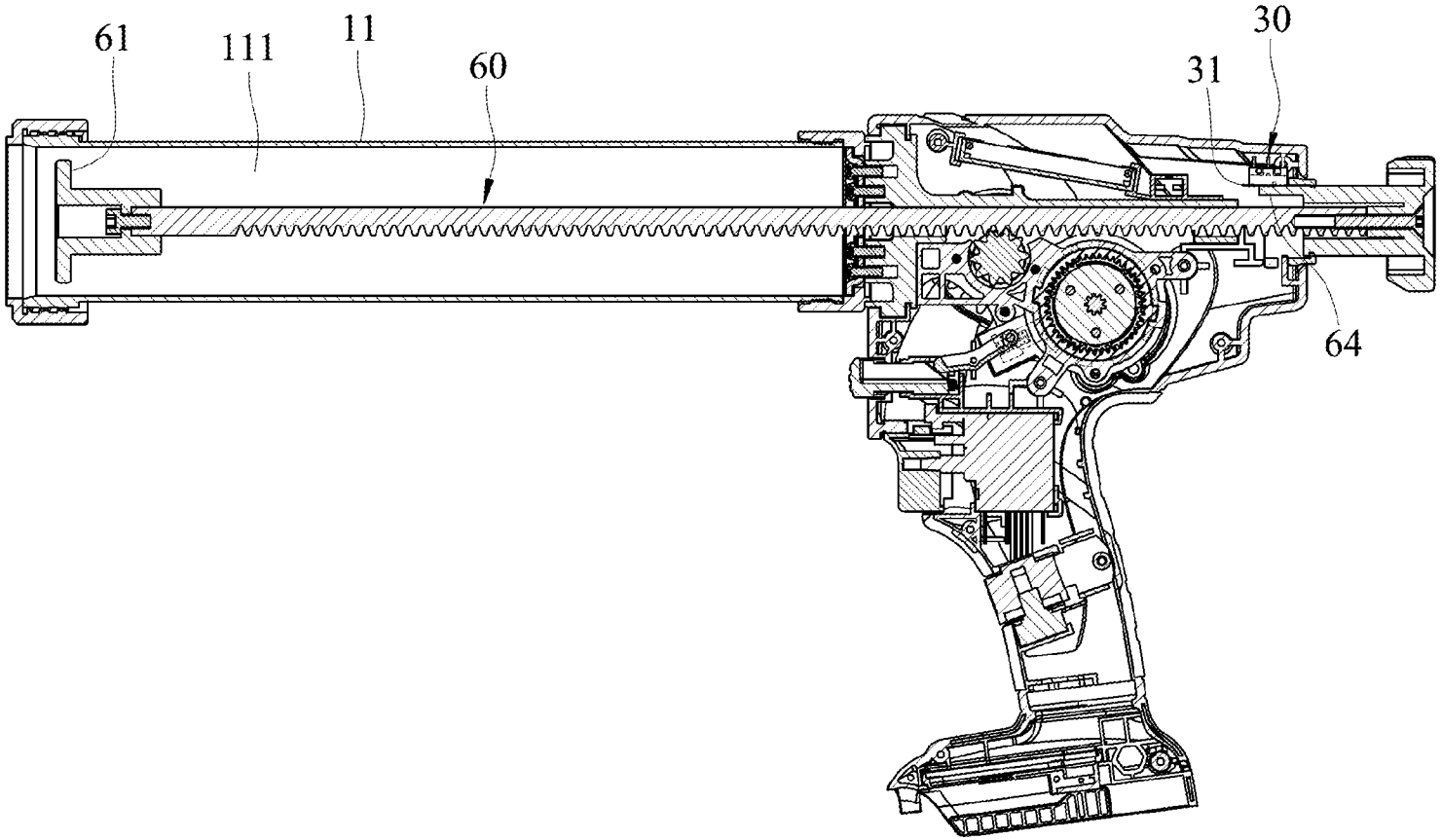
FIG. 8 is a sectional view similar to FIG. 3, illustrating a rod in a first stop position.
Figure 9:
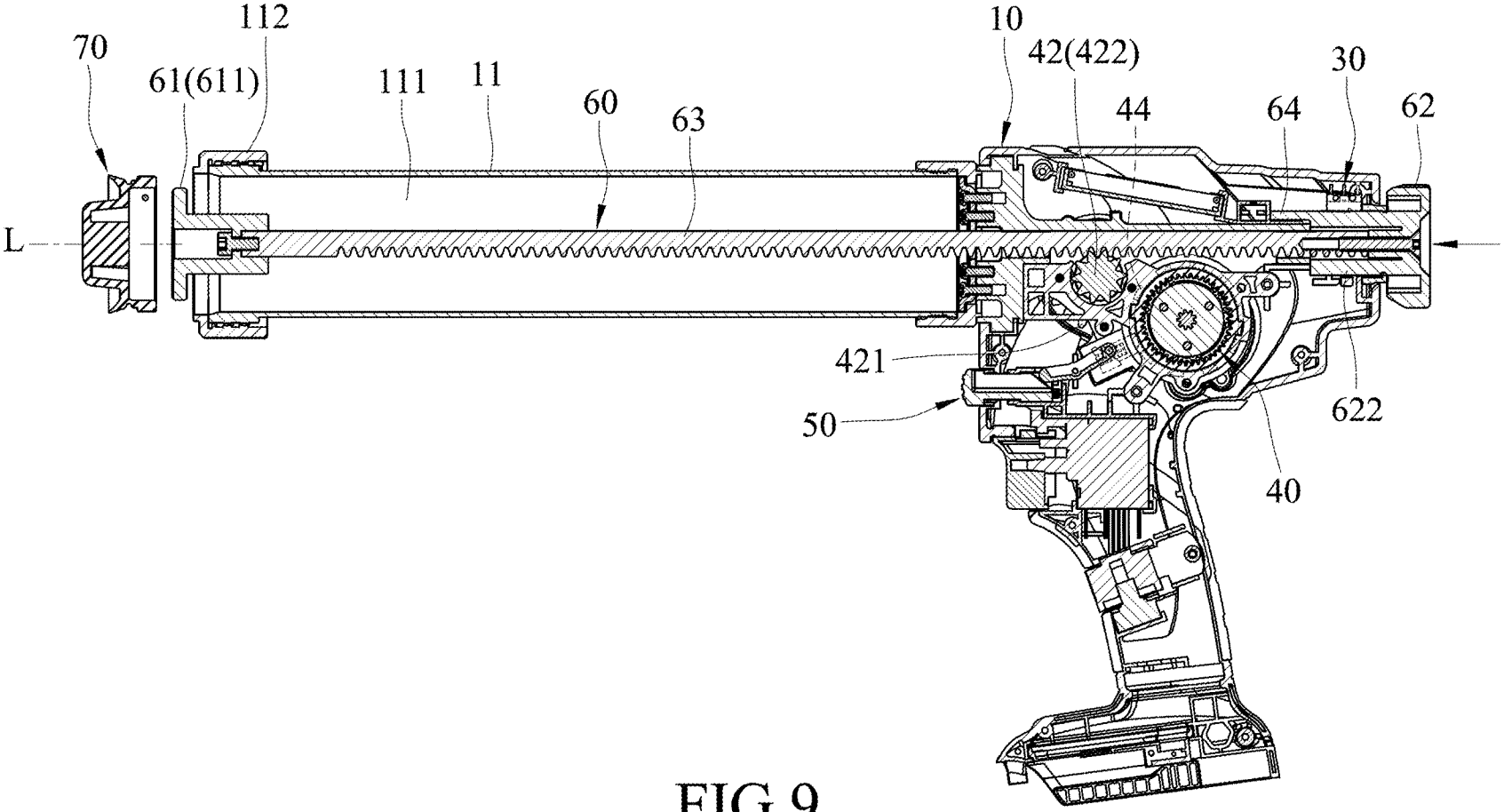
FIG. 9 is a sectional view similar to FIG. 8, illustrating the rod in a second stop position.

The initiating portion 64 is configured such that, when the rod 60 is moved forwardly to a first stop position, as shown in FIG. 8, where the plunger head 61 is disposed in the material packing receiving space 111, the initiating portion 64 is located to press the pressing tongue 31 and actuate the sensing member 30 so as to deactivate the motor 20. The rod 60 can be manually moved from the first stop position to a second stop position, as shown in FIG. 9, where the plunger head 61 projects outwardly of the forward end 112 of the tubular dispensing portion 11 and where the initiating portion 64 is disposed forwardly of the sensing member 30. In this embodiment, when the rod 60 is placed between the first and second stop positions, the sensing member 30 is pressed and actuated by the barrel 622 to stop the motor 20.

Figure 10:
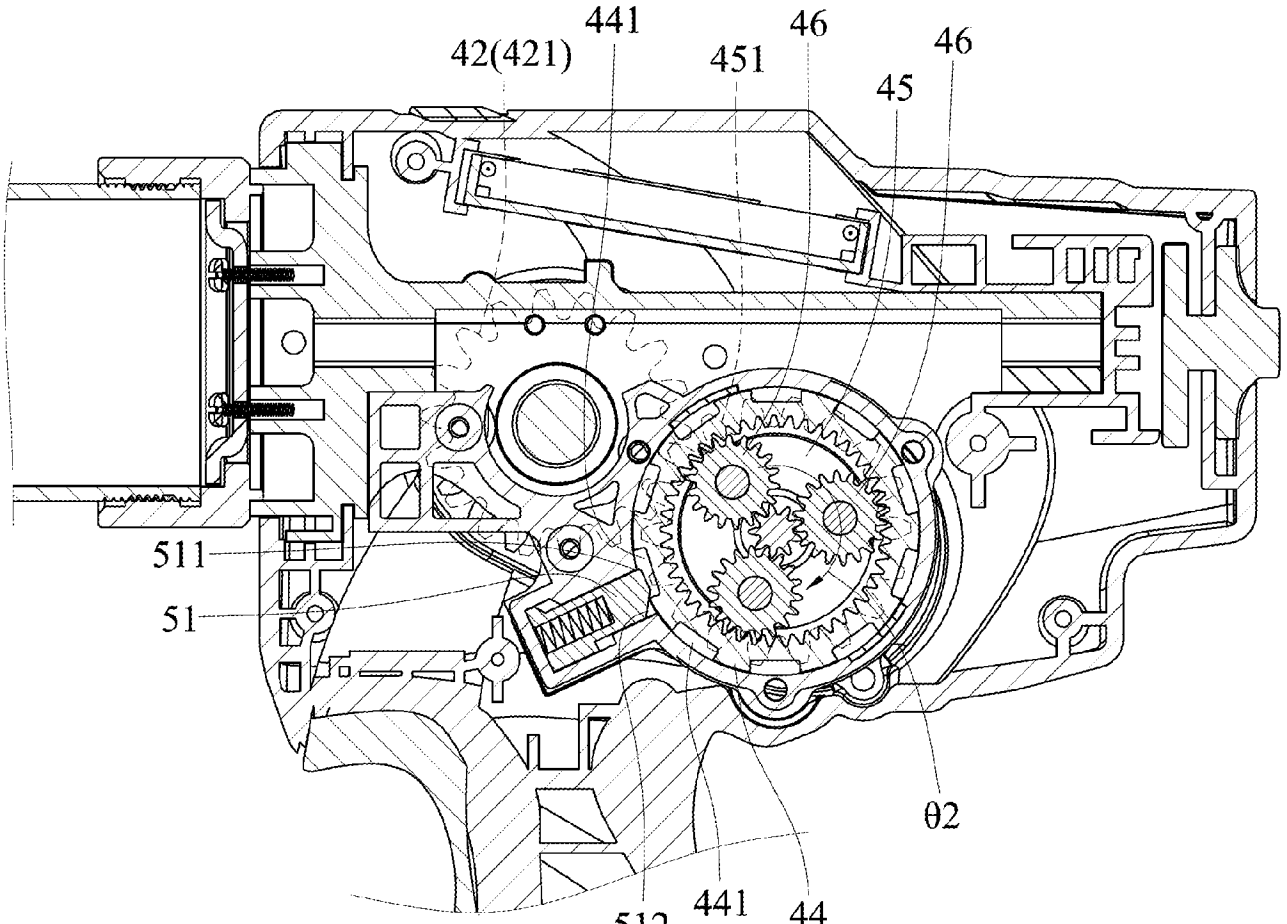
FIG. 10 is a fragmentary sectional view illustrating that an annular gear of a power transmitting mechanism rotates by slipping over the clutch mechanism.

Referring to FIGS. 9 and 10, when the clutch mechanism 50 is in the engaged position and when the rod 60 is moved from the first stop position to the second stop position, the forward movement of the rack portion 63 of the rod 60 makes rotation of the annular gear 44 in a second rotational direction (θ2) opposite to the first rotational direction (θ1) through the transmission of the idle gear 42, the carrier 45 and the planet gears 46 and due to the slipping surface 512 which permits the annular gear 44 to slip thereover. In other words, in this embodiment, the first stop position is an auto-stop position of the rod 60, while the rod 60 is manually operated from the first stop position to the second stop position.

Figure 12:
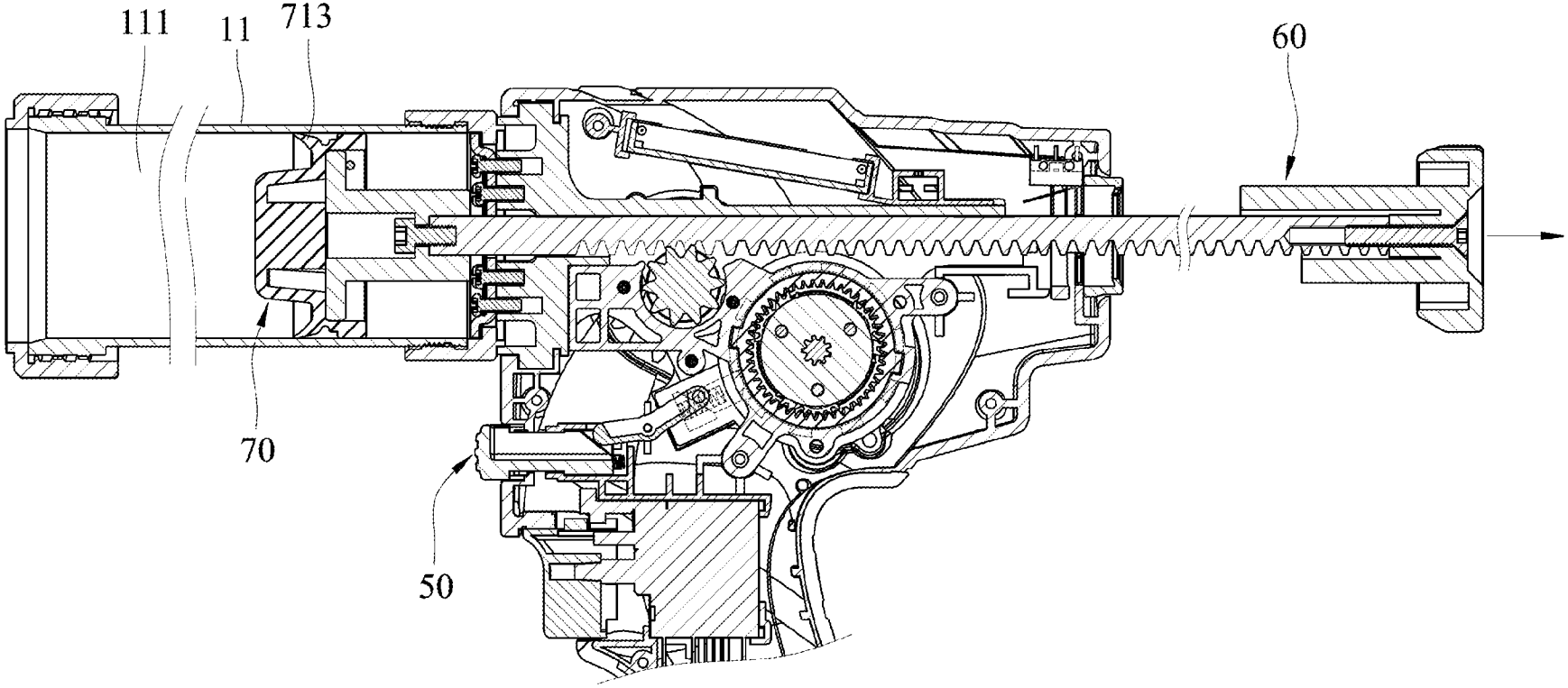
FIG. 12 is a fragmentary sectional view similar to FIG. 11, illustrating that the plunger kit is moved into a tubular dispensing portion of a housing along with the rod.

Referring to FIGS. 3 and 4, the plunger kit 70 is configured to be removably engaged with the plunger head 61 and is movably disposed in the material packing receiving space 111 in the lengthwise direction (L). The plunger kit 70 has a front end wall 711 disposed normal to the lengthwise direction (L), a peripheral wall 712 surrounding an axis in the lengthwise direction (L) and extending rearwardly from a periphery of the front end wall 711 to cooperatively define a mounting space 73, a retaining bar 72 disposed in the mounting space 73 to engage the peripheral wall 712 and extending transverse to the lengthwise direction (L) and offset from the axis, and an annular flange 713 extending outwardly and radially from the front end wall 711. The retaining bar 72 is spaced apart from the front end wall 711 by a clearance 74. In assembly, the thrust wall 611 of the plunger head 61 is fitted in the clearance 74 to retain the plunger kit 70 on the plunger head 61. Hence, the plunger kit 70 is engaged with the plunger head 61 free of using any hand tool when the rod 60 is in the second stop position. As shown in FIG. 12, the annular flange 713 of the plunger kit 7 is configured to be slidable on an inner wall surface of the tubular dispensing portion 11.

In use, with reference to FIG. 3, when the dispensing tool is used with a cardboard tube-style of dispensing material, a cardboard tube-style packing (not shown) is received in the material packing receiving space 111. The motor 20 is then activated by depressing the trigger 12 to move the rod 60 forwardly so as to discharge the dispensing material from the packing.

Figure 11:
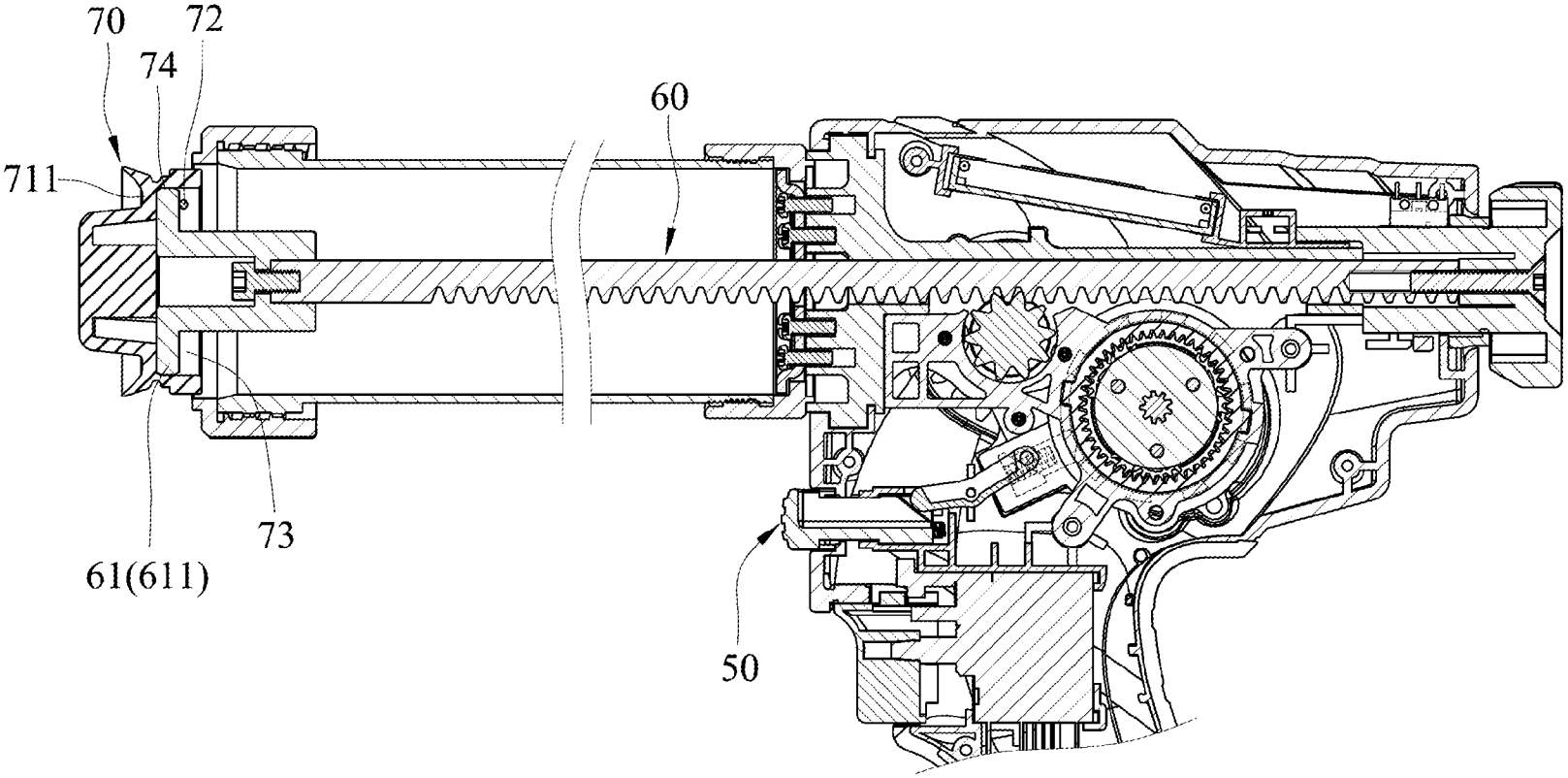
FIG. 11 is a fragmentary sectional view illustrating a plunger kit is attached to the rod.

When it is desired to use the dispensing tool with a sausage pack of dispensing material (with reference to FIGS. 9 and 11), the rod 60 is pushed manually to the second stop position, and the plunger kit 70 is directly attached to the plunger head 61 without using a hand tool. Subsequently, the clutch mechanism 50 is operated manually to the disengaged position such that the rod 60 is pulled manually rearwardly until the plunger kit 70 is placed in a rear end of the tubular dispensing portion 11 (as shown in FIG. 12). In this state, the sausage pack of dispensing material is received in the material packing receiving space 111. The clutch mechanism 50 is in turn moved to the engaged position so as to permit the forward movement of the rod 60 for a dispensing work.

As illustrated, to accommodate different packing styles of dispensing material, by means of movement of the rod 60 to the second stop position, the plunger kit 70 can be attached to or removed from the plunger head 61 without the need to use a hand tool, thereby rendering the displacement operation convenient and rapid, and facilitating transportation and carrying of the dispensing tool. Besides, by means of the slipping surface 512 of the engaging pawl member 51 which permits the annular gear 44 to slip thereover, the rod 60 can be moved manually to the second stop position without manually operating the clutch mechanism 50 to the disengaged position.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A power operated dispensing tool comprising:

a housing having a tubular dispensing portion that extends in a lengthwise direction to define a material packing receiving space therein and to terminate at a forward end;

a motor disposed within said housing;

a sensing member fixed within said housing and electrically connected with said motor;

a power transmitting mechanism disposed within said housing and driven by said motor;

a rod disposed within and movable relative to said housing in the lengthwise direction and having at a front end thereof a plunger head that is disposed in said material packing receiving space, said rod being operably coupled to said power transmitting mechanism so as to make a forward movement driven by a power of said motor through said power transmitting mechanism to discharge a dispensing material in said material packing receiving space, said rod having an initiating portion disposed to actuate said sensing member to deactivate said motor when said rod is moved forwardly to a first stop position, where said plunger head is disposed in said material packing receiving space, said rod being disposed to be manually moved from the first stop position to a second stop position, where said plunger head projects outwardly of said forward end of said tubular dispensing portion and where said initiating portion is disposed forwardly of said sensing member; and a plunger kit configured to be removably engaged with said plunger head and movably disposed in said material packing receiving space in the lengthwise direction.

2. The power operated dispensing tool as claimed in claim 1, wherein said plunger kit is engaged with said plunger head free of using a tool when said rod is moved in the second stop position.

3. The power operated dispensing tool as claimed in claim 2, wherein said plunger kit has a front end wall disposed normal to the lengthwise direction, a peripheral wall surrounding an axis in the lengthwise direction and extending rearwardly from a periphery of said front end wall to cooperatively define a mounting space, and a retaining bar disposed in said mounting space to engage said peripheral wall and extending transverse to the lengthwise direction and offset from the axis, said retaining bar being spaced apart from said front end wall by a clearance, said plunger head having a thrust wall which is fitted in said clearance so as to retain said plunger kit on said plunger head.

4. The power operated dispensing tool as claimed in claim 3, wherein said plunger kit further has an annular flange extending outwardly and radially from said front end wall and configured to be slidable on an inner wall surface of said tubular dispensing portion.

5. The power operated dispensing tool as claimed in claim 2, wherein said rod has an operated portion disposed opposite to said plunger head to extend outwardly of said housing so as to be operated manually, and a rack portion interposed between said operated portion and said plunger head, said initiating portion being disposed between said operated portion and said rack portion and configured to be moved forwardly into said housing along with the forward movement of said rod to the first stop position, where said initiating portion is located to actuate said sensing member to deactivate said motor.

6. The power operated dispensing tool as claimed in claim 5, wherein said sensing member is in the form of a limit switch that is pressed and actuated by said initiating portion to deactivate said motor when said rod is moved between the first stop position and the second stop position.

7. The power operated dispensing tool as claimed in claim 5, further comprising a clutch mechanism disposed within said housing and operable between an engaged position, where said clutch mechanism is engaged with said power transmitting mechanism to permit transmission of the power of said motor to make the forward movement of said rod, and a disengaged position, where said clutch mechanism is disengaged from said power transmitting mechanism such that the power of said motor is not transmitted to said rod.

8. The power operated dispensing tool as claimed in claim 7, wherein said power transmitting mechanism has a planetary gear train which includes a sun gear disposed to receive the power of said motor, an annular gear rotatably disposed within said housing, a carrier rotatable and co-axial with said sun gear, and at least one planet gear pivotably supported on said carrier and meshed with said annular gear, said at least one planet gear being operably coupled with said sun gear, said rack portion of said rod being operably coupled with said carrier such that rotation of said sun gear being translated to a displacement of said rod in the lengthwise direction, said clutch mechanism having an engaging pawl portion movable relative to said power transmitting mechanism such that said clutch mechanism is operable between the engaged position, where said engaging pawl portion is engaged with said annular gear to prevent rotation of said annular gear so as to permit transmission of the power of said motor to said rod, and the disengaged position, where said engaging pawl portion is disengaged from said annular gear so as to permit free rotation of said annular gear to disenable the transmission of said power transmitting mechanism to said rod, and a first biasing member disposed to bias said engaging pawl portion to engage said annular gear.

9. The power operated dispensing tool as claimed in claim 8, wherein said annular gear has a plurality of grooves angularly displaced from each other such that said engaging pawl portion is engaged in one of said grooves in the engaged position to prevent rotation of said annular gear in a first rotational direction, said clutch mechanism having a slipping surface which is disposed opposite to said engaging pawl portion to permit said annular gear to be rotated in a second rotational direction opposite to the first rotational direction by slipping over said slipping surface when said rod is moved from the first stop position to the second stop position to rotate said annular gear through said carrier and said planet gear.

10. The power operated dispensing tool as claimed in claim 9, wherein said clutch mechanism has an engaging pawl member on which said engaging pawl portion and said slipping surface are disposed, a manually operable member movable relative to said housing, a connecting member pivotably disposed on said housing and interconnecting said engaging pawl member and said manually operable member to be turned in response to an inward movement of said manually operable member so as to move said engaging pawl member away from said annular gear.

* * * * *